US008572807B2

(12) United States Patent
Walhorn et al.

(10) Patent No.: US 8,572,807 B2
(45) Date of Patent: Nov. 5, 2013

(54) JOINT HINGE, PARTICULARLY FOR GLASS SWINGING DOORS

(75) Inventors: Oliver Walhorn, Werther (DE); Garry Hodges, Lemgo-Brake (DE)

(73) Assignee: Dorma GmbH + Co. KG, Ennepetal (DE)

( * ) Notice: Subject to any disclaimer, the term of this patent is extended or adjusted under 35 U.S.C. 154(b) by 484 days.

(21) Appl. No.: 12/745,955

(22) PCT Filed: Dec. 4, 2008

(86) PCT No.: PCT/EP2008/010271

§ 371 (c)(1),
(2), (4) Date: Jun. 3, 2010

(87) PCT Pub. No.: WO2009/074258

PCT Pub. Date: Jun. 18, 2009

(65) Prior Publication Data

US 2010/0275409 A1 Nov. 4, 2010

(30) Foreign Application Priority Data

Dec. 12, 2007 (DE) ..... 10 2007 060 302

(51) Int. Cl.
*E05D 5/02* (2006.01)

(52) U.S. Cl.
USPC ..... 16/252; 16/235; 16/332

(58) Field of Classification Search
USPC ..... 16/252, 286, 235, 382, 332, 334, 50, 16/54, 236–238, 242, 284; 49/388
See application file for complete search history.

(56) References Cited

U.S. PATENT DOCUMENTS

| | | | | |
|---|---|---|---|---|
| 5,867,869 | A * | 2/1999 | Garrett et al. | 16/252 |
| 6,161,255 | A * | 12/2000 | Garrett | 16/284 |
| 6,481,055 | B2 * | 11/2002 | Cheng | 16/252 |
| 6,519,811 | B1 * | 2/2003 | Cheng | 16/252 |
| 6,560,821 | B2 * | 5/2003 | Miller et al. | 16/252 |
| 6,704,966 | B1 * | 3/2004 | Kao | 16/252 |
| 6,766,561 | B1 * | 7/2004 | Cheng | 16/235 |
| 6,925,685 | B2 * | 8/2005 | Chen | 16/332 |
| 6,966,150 | B2 * | 11/2005 | Chiang | 49/388 |
| 7,010,832 | B2 * | 3/2006 | Chen | 16/252 |
| 7,114,292 | B2 * | 10/2006 | Chiang | 49/388 |
| 7,188,390 | B2 * | 3/2007 | Cheng | 16/252 |
| 7,900,319 | B2 * | 3/2011 | Bacchetti | 16/252 |

FOREIGN PATENT DOCUMENTS

| | | |
|---|---|---|
| DE | 197 02 863 | 8/1997 |
| DE | 298 11 592 | 9/1998 |
| EP | 0 599 255 | 6/1994 |
| EP | 1 772 578 | 4/2007 |
| EP | 2333212 A1 * | 6/2011 |

* cited by examiner

*Primary Examiner* — William Miller
(74) *Attorney, Agent, or Firm* — Cozen O'Connor

(57) ABSTRACT

A hinge strip for double-action glass doors, with a fixed hinge portion, a door hinge portion pivotable about the fixed hinge portion, a pivoting axis penetrating the fixed hinge portion and the door hinge portion, a cam with at least one depression disposed at the axis, and a force-loaded roller that cooperates with the cam. To achieve a precise adjustment of the zero position of the door, the roller is disposed to be adjustable orthogonally with regard to the longitudinal axis of the hinge strip.

11 Claims, 3 Drawing Sheets

JOINT HINGE, PARTICULARLY FOR GLASS SWINGING DOORS

PRIORITY CLAIM

This is a U.S. national stage of application No. PCT/EP2008/010271, filed on 4 Dec. 2008, which claims Priority to the following German, Application No.: 10 2007 060 302.0, filed: 12 Dec. 2007; the contents of which are incorporated here by reference.

BACKGROUND OF THE INVENTION

1. Field of the Invention

The invention relates to a hinge strip, in particular for double-action glass doors, with a fixed hinge portion, a door hinge portion pivotable about the fixed hinge portion, a pivoting axis penetrating the fixed hinge portion and the door hinge portion, a cam with at least one depression being disposed at said axis, and with a force-loaded roller, which cooperates with the cam.

2. Prior Art

It is desirable in hinge strips to dispose a latching device in the hinge strip to be adjustable to compensate for tolerances when affixing a bearing block at a wall or the like.

EP 0 599 255 A1 describes a hinge strip for double-action glass doors, which allows for correcting the latching position of the door leaf in the mounted condition, to adapt to unevenness of the wall. A body of revolution, rotating about an articulated axis of the hinge strip is disposed in a bearing block screwable to the wall or the like, and which can be locked in different positions with regard to the bearing block. On its exterior circumference, the body of revolution has latching positions into which a spring-loaded latching body engages, which is guided at the pivotable door hinge portion. In this case, the latching body may be supported at a sliding body, which is spring-loaded and displaceable in a carrying body which forms a component of a door hinge portion. In the known device, the ball-shape configured latching body is disposed in the pivotable hinge portion, and serves to secure the door in the closed or in the opened position. Correcting the position of the door leaf in the mounted condition is realized via another sphere or cylinder securable between the bearing block and the body of revolution, which procedure is not precise at all.

SUMMARY OF THE INVENTION

An object according to one embodiment of the invention is an easy way of correcting the latching position of a double-action door in the mounted condition, which allows for a precise adjustment of the zero position of the door.

According to one embodiment of the invention, the roller is disposed to be orthogonally adjustable with regard to the longitudinal axis of the hinge strip. This allows for very small and precise adjusting ranges, such that the zero position of the door can be exactly set.

One embodiment of the invention provides a hinge strip, the fixed hinge portion thereof, to adjust the door leaf in its closed position when compensating for building tolerances in the connecting area—for example a wall—being adjustable with regard to the door hinge portion such that, even after a long period of operation, the door leaf maintains the once adjusted closing position.

BRIEF DESCRIPTION OF DRAWINGS

In the following, further advantages and embodiments of the invention will be explained in detail based on one possible diagrammatically illustrated embodiment, in which.

DETAILED DESCRIPTION OF THE DRAWINGS

Figure 1:
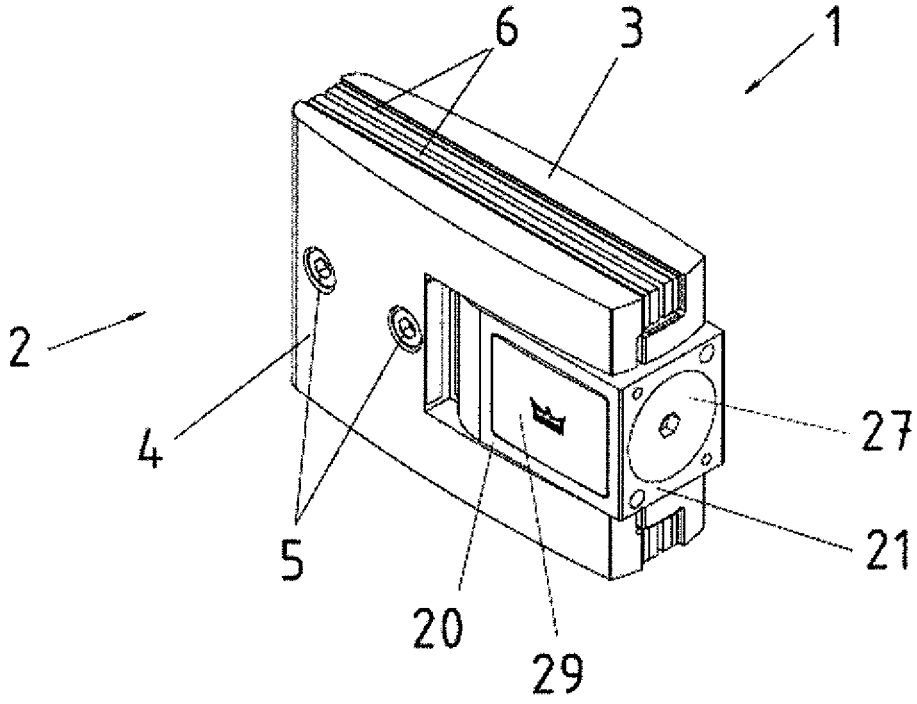
FIG. 1 is a perspective view of a hinge strip.

According to FIG. 1, the hinge strip 1 has a fixed hinge portion, identified here as a bearing block 20, and has a door hinge portion 2. An attaching plate 21, by which the hinge strip 1 is attached to a non-illustrated wall or wall structure, is attached to the bearing block 20. Instead of the bearing block 20, the hinge strip 1 may have another hinge strap to be attached to a glass pane or to a wall element.

The door hinge portion 2 comprises at least a first clamping plate 3 and a second clamping plate 4, which hold a non-illustrated door panel or a glass door in a clamping manner by attaching elements 5. Sealing plates and/or damping plates 6 are disposed between the clamping plates 3, 4 and a glass pane to surround the glass panes in a protective manner.

Figure 2:
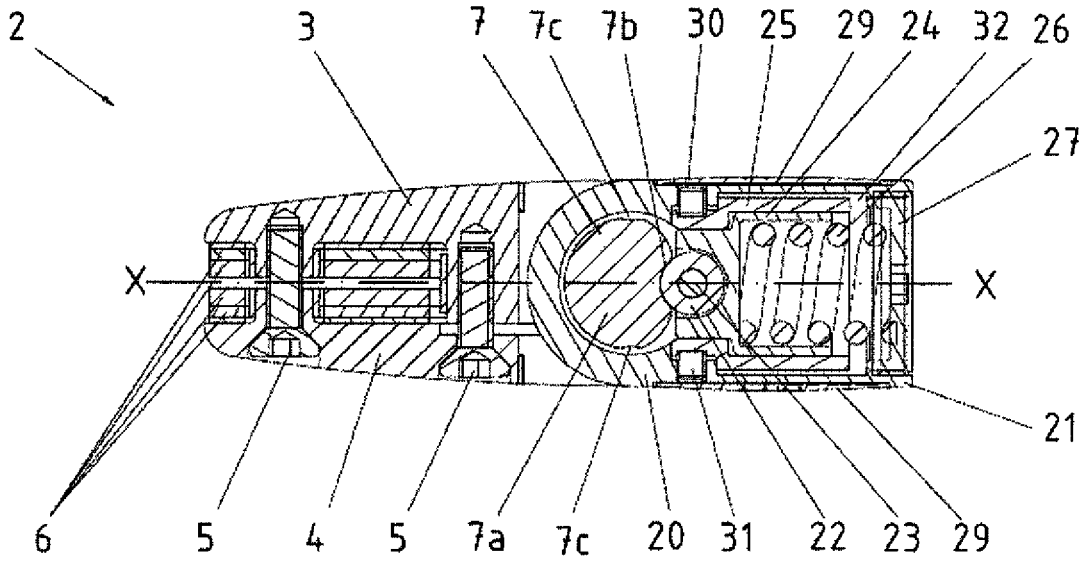
FIG. 2 is a sectional view of the hinge strip.
Figure 3:
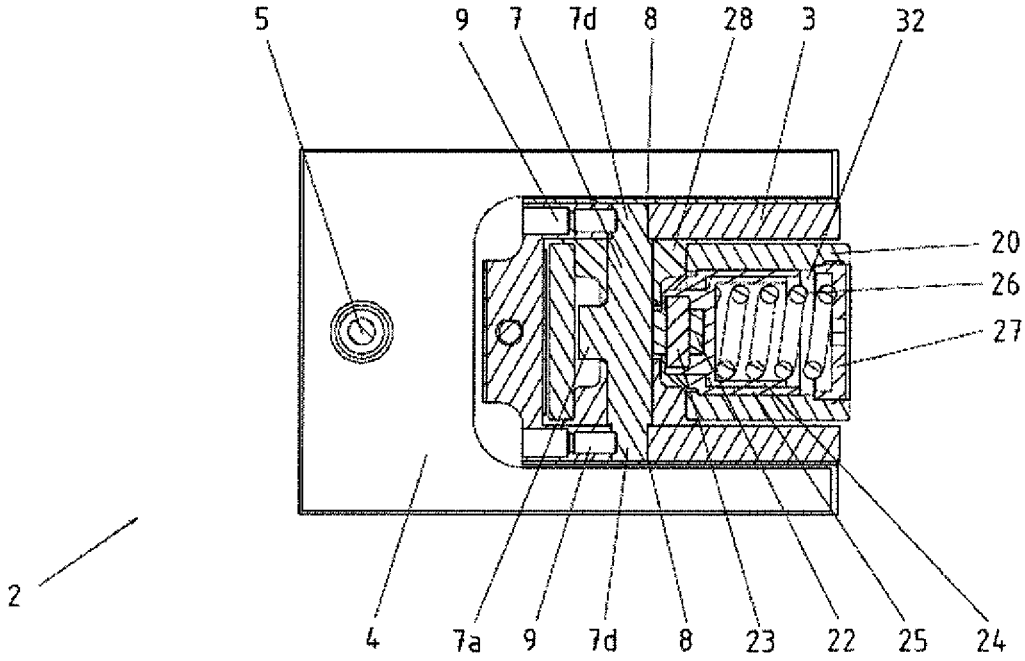
FIG. 3 is a partial sectional view of the hinge strip.

As illustrated in FIG. 2 and FIG. 3, a cam shaft 7 is attached in a torque-proof manner to the first clamping plate 3. In this case, the cam shaft 7 forms the rotating or pivoting axis of the hinge strip 1. In this case, the cam shaft 7 is attached with journals 7*d* in recesses 8 of the first clamping plate 3 and is immobilized in a torque-proof manner with attaching elements 9, for example hammer-tightened rivets or screws. (FIG. 3). A cam 7*a* is disposed on or at a cam shaft 7. A mounting bracket 28, which is attached in the bearing block 20, is disposed above or below the cam 7*a*. The door hinge portion 2 rotates with the cam shaft 7 about the rotating axis when the door is opened, wherein the bearing block 20 is affixed at a wall. The cam 7*a* cooperates with a roller 22, wherein, when operating the hinge strip 1, the surfaces of the cam 7*a* and of the roller 22 roll on each other. A depression 7*b* is disposed in the cam 7*a*, which depression is able to receive at least partially a segment of the circle of the roller 22. Furthermore, one more or several more latching recesses 7*c*, which likewise cooperate with the roller 22, may be disposed on the cam shaft 7.

The cam shaft 7 may be configured as one-part or multi-part. In this embodiment, the cam shaft 7 is executed as one-part, wherein the cam 7*a* is connected to the cam shaft 7 as one-part. (FIG. 2).

The roller 22 is rotatably supported at a roller piston 24 by a bolt 23. The roller piston 24 is disposed to be movable in axial direction in an adjusting cylinder 25. A force acts against the roller piston 24 in an axial direction to press the roller 22 against the cam 7*a*. In this case, the force is essentially exerted in the longitudinal axis of the hinge strip X-X. (FIG. 2). The force may be deployed by a spring 26, hydraulically, or pneumatically. The roller piston 24 is configured as a pot on one side, into which the spring 26 engages at least partially and is guided therein. In this case, the spring 26 is supported at an enclosure 27, which is disposed and attached at or in the attaching plate 21.

In the zero position of the door, the roller 22 is located in the depression 7*b* of the cam 7*a*. As the bearing block 20 is attached to a wall via the attaching plate 21, the clamping plates 3, 4 rotate together with the door about the rotating axis of the hinge strip 1 when opening the door. As the cam shaft 7 is disposed in a torque-proof manner within the first clamping plate 3 via the attaching element 9, the cam shaft 7 rotates within the mounting bracket 28, wherein the cam 7*a* rolls with its surface on the surface of the rotatably disposed roller 22. In this case, the roller 22, together with the roller piston 24, is pressed against the spring 26 and leaves the depression 7*b* during this rotary movement. Another latching recess 7*c* may be disposed at a 90° angle with regard to the depression 7*b*, such that the door stops at this intermediate position. (FIG. 2) This one and even several latching recesses 7*c* may be disposed and distributed in an arbitrary number on the cam 7*a*, depending on the intermediate positions in which the door is supposed to stay open. If the door is closed with force, the cam shaft 7 rotates with the cam 7*a*, until the roller 22 reaches the depression 7*b* again. In this case, depending on size of the spring force, the cam 7*a* with the depression 7*b* swings back and forth several times, wherein, in this case, the roller 22 passes the depression 7*b* of the cam 7*a*, until the momentum of the spring force is more influential than the remaining torque of the door.

To adjust the zero position of the door once the hinge strip 1 has been installed, the cover caps 29 are removed from both sides of the bearing block 20. Within the bearing block 20, the adjusting cylinder 25 can be adjusted by adjusting elements 30, 31 in the shape of screws or the like. In this case, the adjusting cylinder 25 is adjusted, respectively pivoted by a few angular degrees to deviate from the longitudinal axis X-X of the hinge strip, to compensate for building tolerances.

The adjusting cylinder 25 is disposed in a bore 32 within the bearing block 20 with ample radial play. As the adjusting cylinder 25 is attached transversely, respectively orthogonally with regard to the longitudinal axis of the hinge strip X-X by adjusting elements 30, 31, it is no longer movable in axial direction. The action of adjusting the roller 22 via the adjusting cylinder 25 is orthogonal to the spring plane, such that the adjustment of the roller 22 causes a rotation of the cam shaft 7 and thus of the zero position of the hinge strip 1. The axial movement the roller 22 due to the rotation of the cam 7*a* is carried out within the adjusting cylinder 25 by the roller piston 24. In this case, the roller piston 24 with the roller 22, which is rotatably disposed on one side, and with the spring 26, disposed on the other side, is axially movable and guided within the adjusting cylinder 25.

To substantially guarantee an adjustment of the adjusting cylinder 25 as precise as possible within the bore 32, the adjusting elements 30, 31 are disposed in axial longitudinal extension of the adjusting cylinder, if possible at the height of the roller 22 at the bearing block 20, such that, the best possible guidance of the roller 22 in the bearing block 20 is achieved as well.

Depending on the radial play between the adjusting cylinder 25 and the bore 32 and depending on the length of the adjusting cylinder 25, the roller piston 24 and the bore 32, a pivoting of the adjusting cylinder 25 within the bearing block 20 can be carried out, depending on the execution, by deviating between ±0° to 15° from the longitudinal axis of the hinge strip X-X.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A hinge strip, comprising:

a fixed hinge portion configured as a bearing block;

a door hinge portion pivotable about the fixed hinge portion;

a pivot axis passing through the fixed hinge portion and the door hinge portion;

a cam disposed at the pivot axis having at least one depression; and a force-loaded roller rotatably supported in a roller piston and adjustably disposed orthogonally with respect to a longitudinal axis of the hinge strip that cooperates with the cam, wherein the roller piston is arranged in an axially movable manner in an adjusting cylinder.

2. The hinge strip according to claim 1, wherein a camshaft forms the pivoting axis, wherein the camshaft is supported in a torque-proof manner in the door hinge portion.

3. The hinge strip according to claim 2, wherein the door hinge portion comprises:

a first clamping plate;

a second clamping plate configured to mate with the first clamping plate to retain a door element; and one or more journals arranged in recesses of the first clamping plate configured to fix the cam shaft in a torque-proof manner.

4. The hinge strip according to claim 1, wherein the roller piston rotatably supporting the force-loaded roller is arranged in the bearing block.

5. The hinge strip according to claim 1, further comprising a spring configured to act on the roller piston.

6. The hinge strip according to claim 5, wherein the roller piston is arranged in a bore of the bearing block with radial play.

7. The hinge strip according to claim 6, further comprising at least one adjuster configured to orthogonally pivot the adjusting cylinder with respect to the longitudinal axis of the hinge strip.

8. The hinge strip according to claim 7, wherein the pivoting of the adjusting cylinder within the bearing block comprises deviating between about 0° to ±15° from the longitudinal axis of the hinge strip.

9. The hinge strip according to claim 1, wherein the hinge strip is configured for double-action glass doors.

10. The hinge strip according to claim 1, wherein the door hinge portion comprises:

a first clamping plate;

a second clamping plate configured to mate with the first clamping plate to retain a door element; and one or more journals arranged in recesses of the first clamping plate.

11. The hinge strip according to claim 7, wherein the pivoting of the adjusting cylinder within the bearing block comprises deviating less than ±15° from the longitudinal axis of the hinge strip.

* * * * *